United States Patent [19]

Clausen et al.

[11] 4,150,800

[45] Apr. 24, 1979

[54] STRING TYPE ADHESIVE DISPENSING SYSTEM

[75] Inventors: Victor H. Clausen; Charles E. Asbury, Jr., both of Vancouver, Wash.

[73] Assignee: H. B. Fuller Company, St. Paul, Minn.

[21] Appl. No.: 903,857

[22] Filed: May 8, 1978

[51] Int. Cl.[2] ..... B65H 49/02

[52] U.S. Cl. ..... 242/131; 242/156.2

[58] Field of Search ..... 242/131, 131.1, 129.8, 242/156–156.2, 147 R, 151, 153–155 BW

[56] References Cited

U.S. PATENT DOCUMENTS

| | | | |
|---|---|---|---|
| 2,983,468 | 5/1961 | Perrella | 242/156.2 |
| 3,057,578 | 10/1962 | James | 242/156.2 |
| 3,542,309 | 11/1970 | Willis et al. | 242/131 |
| 3,826,438 | 7/1974 | Stanley | 242/156.2 |

*Primary Examiner*—Leonard D. Christian

*Attorney, Agent, or Firm*—Merchant, Gould, Smith, Edell, Welter & Schmidt

[57] ABSTRACT

Apparatus for dispensing a plurality of string members, in particular thread or filaments coated with hot melt adhesives, to a machine wherein the string members are applied to a moving web. The apparatus includes a device for simultaneously regulating the tension on each of the string members. In the preferred embodiment, the tension regulating device includes a pair of cylindrical rollers disposed transverse to the direction of string member travel and about which the string members are wrapped. A braking mechanism is included to provide controlled resistance to the rotation of the cylindrical rollers and thereby regulate the tension on the string members.

21 Claims, 9 Drawing Figures

FIG. 1
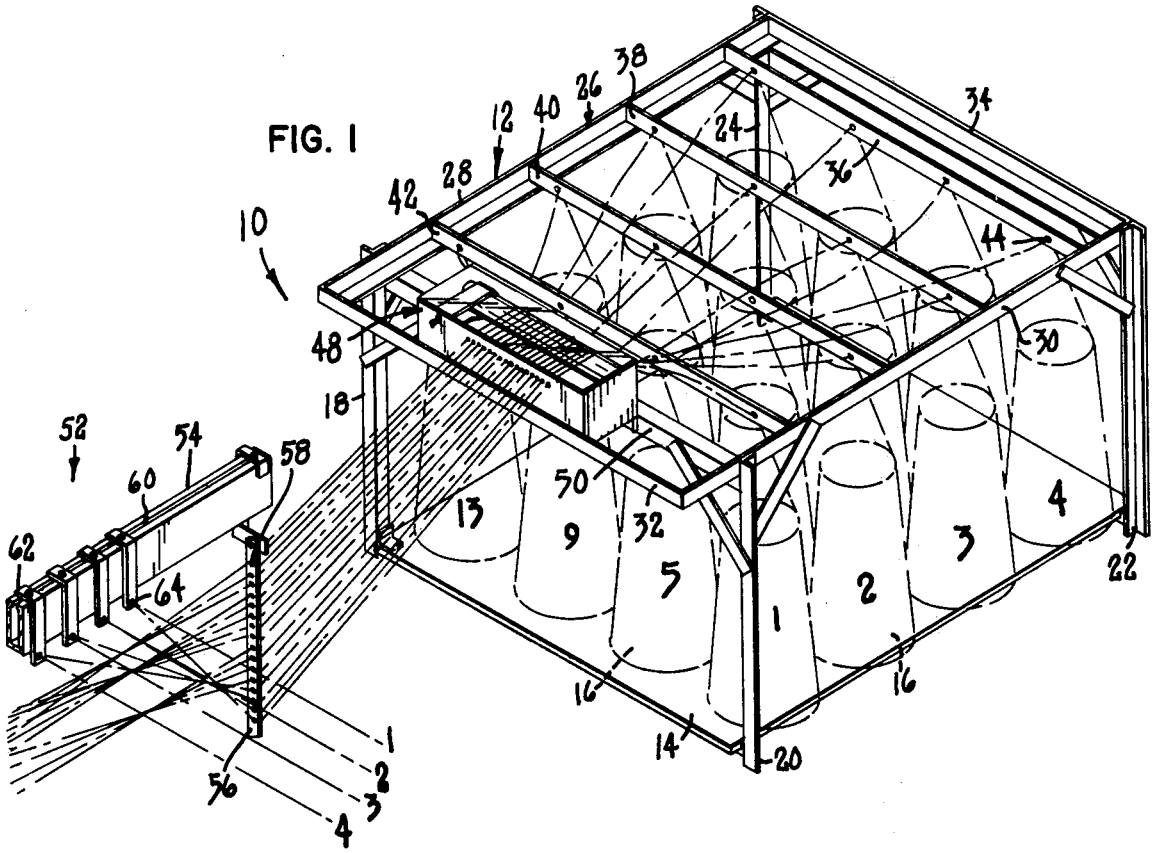
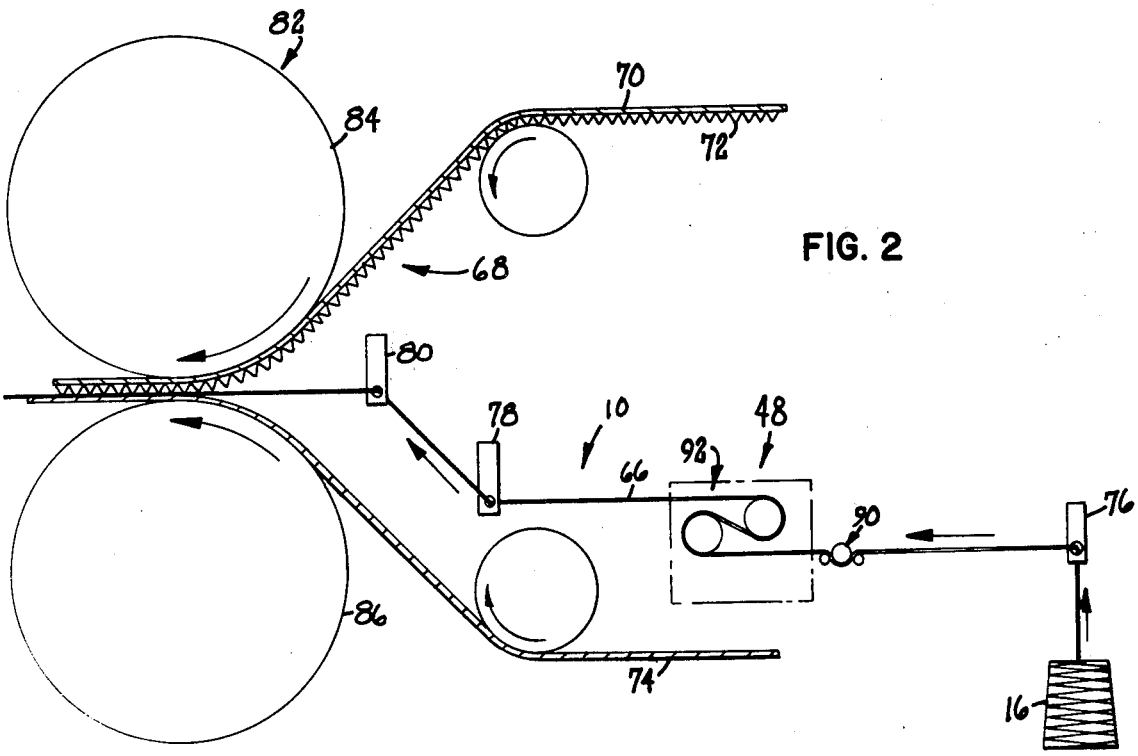
FIG. 2

STRING TYPE ADHESIVE DISPENSING SYSTEM

BACKGROUND OF THE INVENTION

The present invention is an apparatus for dispensing various kinds of strings or threads or the like. In particular, the present invention relates to an apparatus for dispensing various different kinds of threads and strings et cetera which are coated with adhesives and which are applied to various web materials to laminate substrates together or to reinforce the web material.

Threads, strings, rovings and monofilaments which are coated with adhesives are known in the prior art and have been used to laminate web substrates together and/or reinforce web materials. The assignee of the present invention manufactures and distributes under the trade name LINEAR® adhesives and STRING KING® types of strings, threads and monofilaments coated with thermoplastic adhesive commonly referred to as "hot melt" adhesive. For example, a typical STRING KING product is a strand consisting of numerous continuous synthetic filaments uniformly coated with the thermoplastic hot melt adhesive. The hot melt adhesives are solids at normal ambient temperatures but become soft as they are heated and will flow at elevated temperatures. The apparatus of the present invention is specifically designed to feed STRING KING reinforcements onto web materials. In one such application that has found significant success the STRING KING reinforcements are utilized in the manufacture of corrugated board whereby the adhesive coated string is deposited between the liner board and flute in the continuous web manufacturing process.

The string adhesive products are typically supplied on cylinder rolls that may contain anywhere from 20,000 to 100,000 feet of string. The string is typically removed from the end of the individual rolls. Alignment of the string on the moving web to which it is applied is critical in many instances and therefore accurate placement is desired. Additionally, different industrial operations which use the string adhesives may operate at a variety of speeds. For example, it is not uncommon for corrugating operations to run at 200–300 feet per minute, but some are also known to run as slowly as 150 feet per minute or as fast as 600 feet per minute. Thus, the string adhesive dispensing device must be capable of feeding the string at whatever speed is demanded by the particular application. In many applications a number of such strings are used at the same time and the dispensing device must therefore be capable of handling a plurality of rolls of string.

The prior art dispensing system developed by the assignee of the present invention includes a dispensing rack on which may be mounted a plurality of rolls of string adhesive. A guide track is provided and mounted in a suitable location with respect to the corrugating machine or other moving web apparatus in order to guide the individual string adhesives onto the moving web. String adhesives are fed from the dispensing rack to the guide track through eye bolts, one each of which is provided on the rack for each roll of string adhesive. These eye bolts through which the string adhesive passes can be turned or oriented to adjust the tension on each individual string. It has been found that the proper control of the string tension is necessary to ensure a trouble-free operation. Too little tension often results in poor bonding and inaccurate string placement on the moving web. Excessive tension will obviously cause string breakage. It is desirable to operate with the minimum tension required to eliminate any slack in the string adhesive as it is guided onto the moving web.

Obviously, in the prior art apparatus, the tension on each individual string must be independently adjusted. Thus, it is almost physically impossible to maintain equal tension on the plurality of string adhesives as would be preferred. Additionally, in the prior art apparatus wherein the eye bolts are used to regulate the tension, it has been found that special care must be taken to ensure that all the eye bolts and guides remain smooth and have no rough surfaces that will increase drag.

Therefore, the dispensing apparatus of the present invention was developed to eliminate the tensioning problems associated with the prior art and to provide a dispensing apparatus wherein a single manual adjustment could be made to regulate the tension on all of the string adhesives fed from the dispensing apparatus and wherein equal tension could be established on each of the individual string adhesives. Thus, with the minimum of operator adjustment, tension on the individual strings can be regulated and maintained equally distributed over a plurality of such strings to ensure proper alignment and application of the string adhesives to the moving web in a particular application. In the apparatus of the present invention, the tension is also more accurately controlled as compared to the prior art wherein individual eye bolts had to be adjusted to provide the necessary drag on the string adhesive to develop the desired tension.

SUMMARY OF THE INVENTION

The present invention is an apparatus for dispensing a plurality of string members from associated supply spools to a machine wherein the string members are applied to a moving web. The machine provides the force to pull or draw the string members from the dispensing apparatus. The dispensing apparatus includes a rack on which may be mounted a plurality of supply spools of string members. The dispensing rack is provided with means for applying drag on the string members in resistance to the pull on the string members by the machine. The apparatus further includes means for simultaneously regulating the tension on each of the string members with this regulating means being disposed on the dispensing rack to receive the string members from the drag means. Guide means is connected to the machine for guiding the string members from the tension regulating means to the moving web and finally means are provided on the dispensing rack for guiding the string members from the supply spool to the drag means.

In the preferred embodiment, the tension regulating means includes first and second substantially cylindrical roller members mounted to the housing and having rotational axes disposed generally transverse to the path of the string members. The rotational axes of the first and second roller members are disposed in parallel horizontal planes which are vertically offset with respect to each other. The string members are first wrapped about and in frictional contact with a generally frontwardly facing side of the lower of the first and second roller members and then wrapped about and in contact with a generally rearwardly facing side of the upper of said roller members. Adjustable brake means are included to provide controlled resistance to the rotation of the roller members to thereby regulate the tension on the string members which exit from the tensioning means. Preferably, the brake means comprises a strap having first and second oppositely disposed surfaces and is wrapped about the upper roller with the first surface in frictional contact with the upper roller member and the oppositely disposed second surface in frictional contact with the lower roller member. Means are provided for adjustably affixing the strap to the rack whereby the degree of frictional contact between the strap and the roller members may be increased or decreased to thereby regulate tension on the string members.

The first and second roller members are mounted in a housing having oppositely disposed sides each with a plurality of aligned spaced apertures to guide the string members into and out of the housing. The two substantially cylindrical roller members are rotatably mounted in side walls of the housing.

The drag application means includes a plurality of rod members mounted to the rack and affixed against rotation. In the preferred embodiment three such rod members are utilized, each having a longitudinal axis aligned transverse to the path of the string members with the rod members spaced apart so that the string members are threaded about and in frictional contact with the outer surfaces of the rod members. The first and second rod members have equal outside diameters while the third rod member has an outside diameter greater than the outside diameter of the first and second rod members. The third rod member is disposed intermediate the first and second rod members and the three rod members are aligned such that the bottom surfaces thereof lie in a single horizontal plane with the string members being threaded above the first and second rod members and beneath the third rod member and in frictional contact therewith. By applying a slight drag on the string members in resistance to the pull from the machine, the string members more effectively grab and are in frictional contact with the roller members of the primary tensioning means.

The roller members of the tensioning means of the present invention exhibit load-sharing characteristics in the sense that if one of the string members develops more or less drag as it is pulled from its individual supply roll or as it builds up drag going through the guide members, the extra load is overcome and difference in tension of the strings going into the machine wherein they are applied to the moving web are eliminated.

A single manual adjustment is required to control the frictional contact of the strap with the roller member and thereby control the tension on the string exiting from the tensioning means.

From the above description, it can be seen that the present invention is a dispensing apparatus having means for accurately regulating the tension on a plurality of string adhesive members and maintaining the tension on each of the string members equal. Proper alignment of the string adhesive members onto the moving web is thus ensured with a minimum of operator attention and adjustment. These and other advantages of the present invention will become apparent with reference to the accompanying drawings, detailed description of the preferred embodiment, and claims.

BRIEF DESCRIPTION OF THE DRAWINGS

FIG. 1 is a view in perspective illustrating the dispensing apparatus of the present invention;

FIG. 2 is a diagrammatic view illustrating in general terms the operation of the present invention in the manufacture of corrugated board;

DETAILED DESCRIPTION OF THE PREFERRED EMBODIMENT

Figure 3:
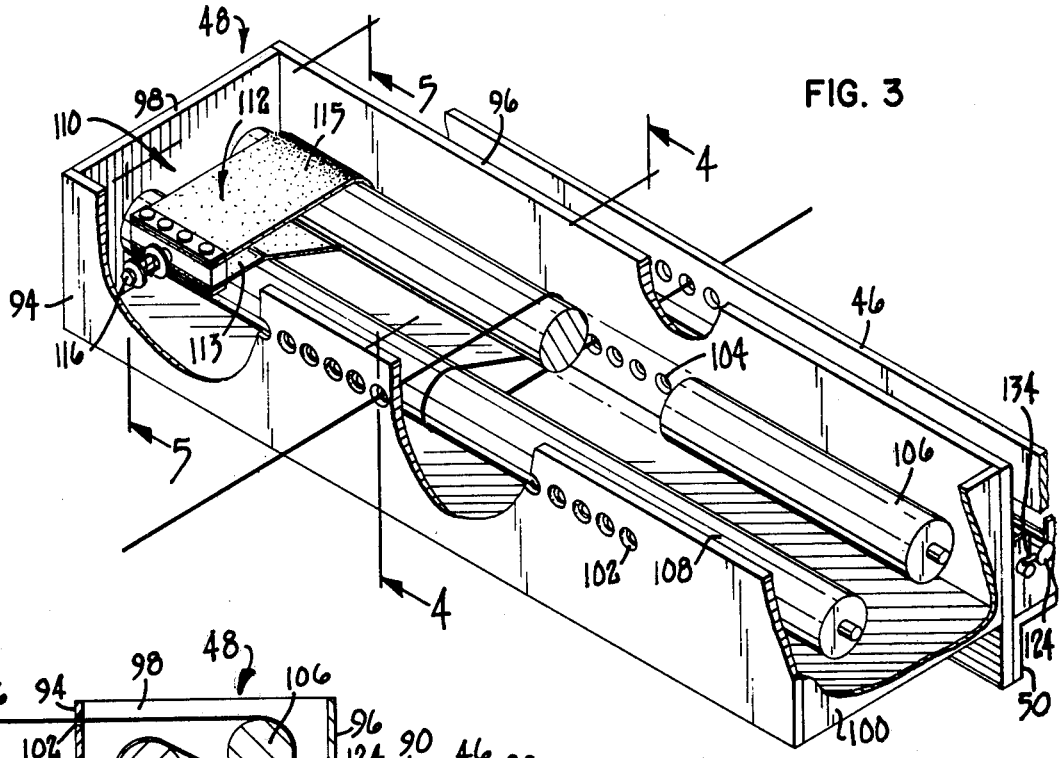
FIG. 3 is an enlarged view in perspective of the tensioning mechanism of the present invention with portions thereof broken away.
Figure 4:
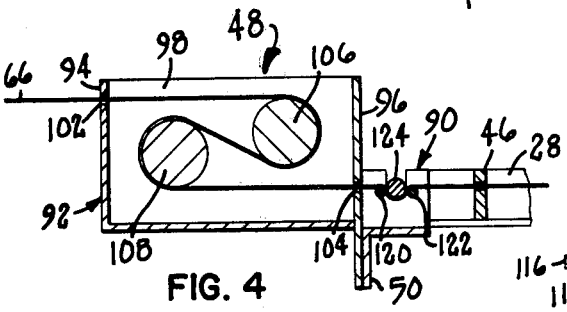
FIG. 4 is a sectional view taken generally along lines 4—4 of FIG. 3.
Figure 5:
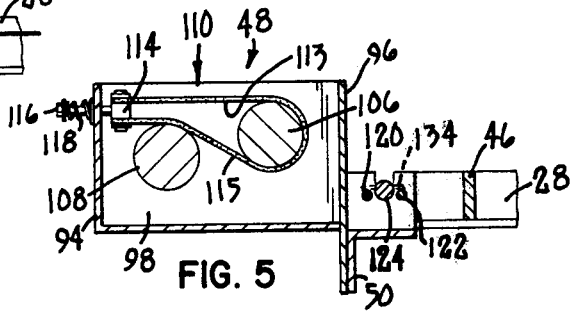
FIG. 5 is a sectional view taken generally along the lines 5—5 of FIG. 3.
Figure 6:
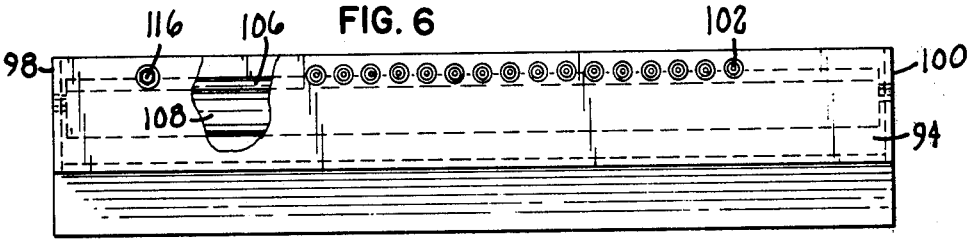
FIG. 6 is an enlarged elevational view of the tensioning apparatus of the present invention with a portion thereof broken away.
Figure 7:
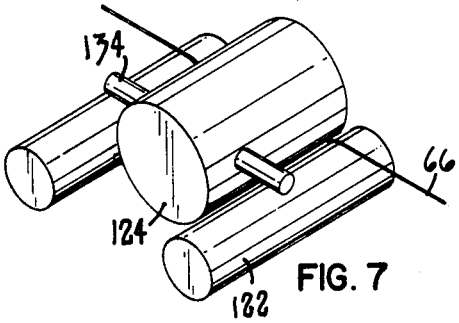
FIG. 7 is an enlarged fragmentary view in perspective illustrating the mounting of a drag application means of the present invention.

Referring to the drawings, wherein like numerals represent like parts throughout the several views, FIG. 1 is a view in perspective illustrating the dispensing apparatus of the present invention designated generally as 10. Apparatus 10 includes a rack 12 having a platform 14 on which is mounted a plurality of spools 16 of string. In a primary application of the apparatus of the present invention, the string is a linear adhesive which may be any of a number of kinds of thread, string, rovings, and monofilaments coated with a hot melt adhesive. It will be understood, however, that the apparatus of the present invention can be used in any type of string dispensing applications.

Rack 12 has upright leg members 18, 20, 22, and 24 which support a generally horizontally disposed top rack portion 26. Top rack portion 26 has side members 28 and 30, a front end member 32 and a rear end member 34. A plurality of horizontally disposed guide bars 36, 38, 40, and 42 which extend between and are affixed to side members 28 and 30. Each of guide bars 36–42 is disposed generally above a row of string spools 16. Each guide bar is provided with a plurality of apertures, as indicated at 44 through which string from a spool 16 is threaded as will be described in more detail hereafter. Apertures 44 are spaced apart along guide bars 36–42 such that an aperture 44 will generally be positioned above the location of a spool 16. Also connected to rack portion 26 is a horizontal guide bar 46. Guide bar 46 is provided with a plurality of apertures 44. The number of apertures 44 in guide bar 46 is at least equal to or greater than the number of apertures 44 in guide bars 36–42. A tension control device 48 is mounted on front end member 32 and a horizontal support member 50. Horizontal support member 50 is secured to leg members 18 and 20 and side members 28 and 30. Tension control device 48 will be described in more detail hereafter in particular with reference to FIGS. 3–8.

Dispensing apparatus 10 also includes an assembly 52 for distributing and guiding strings from rack 12 into a machine (not shown in FIG. 1) wherein the strings are applied to a moving web (also not shown in FIG. 1). Assembly 52 includes a guide track 54 which may be mounted to the machinery by any convenient manner so that guide track 54 is oriented generally transversely with respect to the moving web. Affixed to guide track 54 at one end thereof is a distributor bar 56 having a plurality of apertures 58 disposed therein. The number of apertures 58 corresponds to the spool capacity of rack 12 with each such aperture 58 associated with a spool 16. As illustrated in FIG. 1, distributor bar 56 is oriented generally downward with respect to guide track 54, however, distributor bar 56 is typically adjustably mounted to guide track 54 such that the orientation of bar 56 can be varied as required for particular machinery applications. Guide track 54 is in the preferred embodiment a channel member having a slot 60 extending longitudinally thereof. Adjustably mounted to guide track 54 are a plurality of individual string guide members 62 having apertures 64 therein. Guide members 62 are adjustably mounted to guide rack 54 utilizing conventional fastening means (not shown) extending into slot 60. Guide members 62 serve to alter the direction of string travel from an orientation generally transverse to the moving web as the string passes from distributor bar 56 to guide member 62 to an orientation aligned with the direction of travel of the moving web. Only a portion of guide track 54 is shown in FIG. 1, however, it should be noted that guide track 54 will typically extend across the width of the moving web to which the strings are to be applied Additionally, it should be understood that one guide member 62 is provided for each string from rack 12 and that guide member 62 can be adjustably positioned along a guide track 54 to position the strings on the moving web in any desired spacing.

FIG. 2 illustrates schematically the present invention in a system for reinforcing corrugated board. Dispensing apparatus 10 supplies reinforcing string, one of which is shown at 66 to a machine 68 for manufacturing corrugated board. It is understood that dispensing apparatus 10 can be used in any system for application of string onto a moving web and that the corrugating apparatus shown in FIG. 2 is by way of illustration only. Machine 68 generates corrugated board by combining first moving web 70 having flutes 72 on the inner face thereof to a second moving web or liner 74. Reinforcing string 66, which preferably is a linear adhesive string, is applied in the direction of moving webs 70 and 74. Tension control device 48 is illustrated diagrammatically in FIG. 2 and a single supply spool and horizontal guide bar 76 is shown for illustration. The distributor bar is illustrated diagrammatically at 78 and the guide track and guide member apparatus is shown diagrammatically at 80. The force tending to pull string 66 from spool 16 is applied by machine 68, typically by a double backer nip 82 comprising cooperating rollers 84 and 86.

Tension control device 48 of the present invention is illustrated in more detail in FIGS. 3–8. Control device 48 includes a pretensioning mechanism 90 and a primary tensioning mechanism 92. Primary tensioning mechanism 92 includes a housing having a front wall 94, a rear wall 96, and end walls 98 and 100. Front wall 94 is provided with a plurality of aligned spaced apertures 102 while rear wall 96 has an equal number of aligned spaced apertures 104. Apertures 102 and 104 are disposed generally in horizontal planes that are displaced vertically with respect to each other. In particular, apertures 102 lie in a plane positioned generally above a plane containing apertures 104. Rotatably mounted to end walls 98 and 100 is a pair of cylindrical roller members 106 and 108. The central rotational axes of roller members 106 and 108 are similarly disposed in horizontal planes that are vertically offset with respect to each other. Roller 108 is disposed proximate front wall 94 and has its central rotational axis lying in a horizontal plane which is lower than a horizontal plane containing the central rotational axis of roller member 106 that is positioned proximate rear wall 96. Roller members 106 and 108 are provided with a braking system 110 to provide controlled and adjustable resistance to rotation of the roller members. The braking system includes a strap 112 wrapped about roller member 106 having an inner surface 113 and in frictional contact with roller member 106 and an outer surface 115 in frictional contact with a portion of the circumferential surface thereof. Strap 112 is fastened together with a clamp 114 into which is threadably secured a bolt 116 extending through front wall 94. A spring 118 is positioned between front wall 94 and the head of bolt 116 and coiled about bolt 116. When bolt 116 is tightened, spring 118 is compressed applying tension to strap 112 increasing the frictional contact between strap 112 and roller members 106 and 108 thereby increasing the resistance to rotation of roller members 106 and 108.

String from rack 12 enters primary tensioning mechanism 92 through apertures 104 and is wound about the generally frontwardly facing circumference of roller 108 to undergo substantially a 180 degree reversal of direction. The string is then wound about the generally rearwardly facing circumference of roller 106 and reverses direction to exit from primary tensioning mechanism 92 through apertures 102. Tension is imparted to the string through the frictional contact of the string with rollers 106 and 108. Interposed in the path of the string travel between rack 12 and primary tension mechanism 92 is a pretensioning mechanism 90. Pretensioning mechanism 90 includes three spaced rods 120, 122, and 124. Rods 120 and 122 are in the preferred embodiment rigidly mounted in cradle members 126 and 128 which are affixed to rack 12. Rod 124 is removably mounted in elongated slots 130 and 132 formed in cradle members 126 and 128, respectively. Rod 124 is of larger diameter than rods 120 and 122. Typically rods 120 and 122 are $\frac{3}{8}''$ diameter while rod 124 has a $\frac{3}{4}''$ diameter. Rods 120, 122, and 124 are mounted so that their central longitudinal axes are transverse to the string path. Additionally, rods 120, 122 amd 124 are mounted so that the bottoms of all three rods are aligned in a single horizontal plane. As previously mentioned, rod 124 is removably mounted in cradle members 126 and 128 and held thereon by its own weight. Pins 134 are affixed to rod 124 proximate its outer ends to prevent rod 124 from rotating as string is drawn through mechanism 90 in addition to preventing lateral translation of rod 124 or movement in a direction transverse to string direction. The string passes over rods 120 and 122 and under rod 124 and in frictional contact therewith. Rods 120, 122 and 124 are rigidly secured and therefore do not rotate as the string passes through pretensioning mechanism 90. Rod 124 is removed for threading of the string through mechanism 90. The frictional contact of the string and rods 120, 122 and 124 develops a drag or resistance to the pull of the string through tensioning control device 48 such that the string will tend to move effectively grab the surface of rollers 106 and 108 which are primarily used to control string tension.

Figure 8:
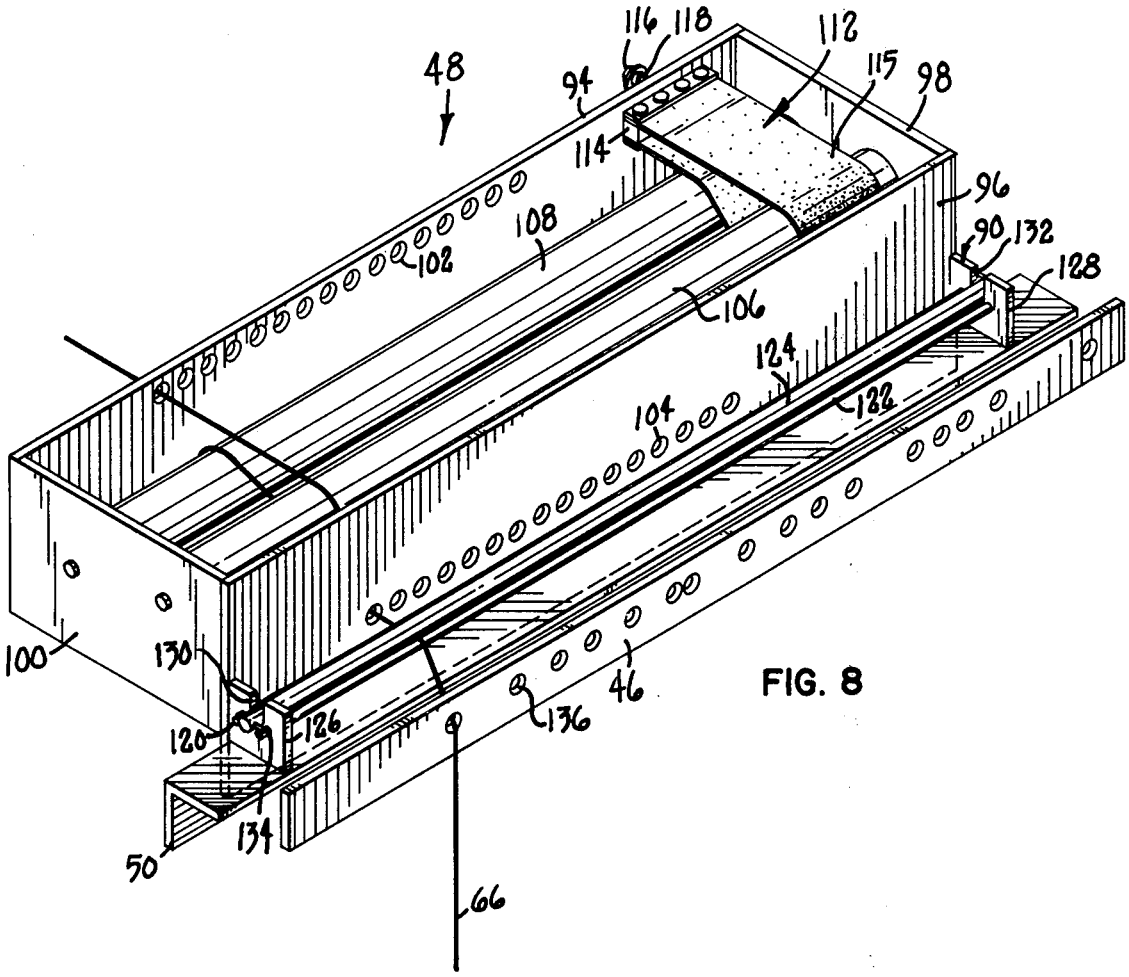
FIG. 8 is an enlarged view in perspective taken generally from the rear of the tensioning apparatus of the present invention.

As shown in more detail in FIG. 8, horizontal guide bar 46 has a plurality of apertures 136 spaced at varying intervals thereacross through which the string is threaded from guide bars 36–42. One such aperture 136 is provided for each spool of string and the uneven spacing of aperture 136 has been found to provide optimum separation of the string as it is removed from the spools and directed into tension control device 48. Thus, the chances of strings from separate rolls becoming entangled is minimized.

Figure 9:
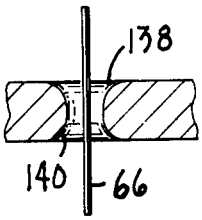
FIG. 9 is an enlarged fragmentary view in section illustrating the structure of guide holes or apertures in the present invention.

FIG. 9 illustrates in detail the configuration of one of the apertures through which the string is threaded. Each aperture through which the string travels is similarly shaped to ensure proper tension control on the strings. The apertures or guide holes are preferably 15/16" diameter through 3/16" steel plates which form the guide bars and tension control device housing. The apertures are rounded at the edges 136 and 138 thereof, and in the preferred embodiment are milled to a 3/32" radius. It has been found that the tension in the string can increase to intolerable limits when the string travels around or across a square corner or a corner having a relatively small curvature. The guide hole or aperture configuration thus described substantially eliminates these problems of uncontrollable tension build up.

In operation, the string, typically a linear adhesive, is initially threaded from spools 16 through apertures 44 in guide bars 36–42 and then through apertures 136 to tension control device 48. Rod 124 is lifted such that the string can be threaded over rods 120 and 122 and beneath rod 124. From pretensioning mechanism 90 the string is threaded through apertures 104 and wrapped about rollers 108 and 106 to exit through apertures 102. The string is then passed through apertures 58 in distributor bar 56. From distributor bar 56 individual strings are directed to individual guide members 62 which redirect the string toward the point of application to the assembly being manufactured. The numerals denoting individual spools 16 in FIG. 1 illustrate the threading of the string through dispensing apparatus 10. In a typical application, in start-up the ends of the individual strings are gathered together and tied and the knot of tied strings are inserted onto the moving web 74 just prior to the double backer nip 82. After travelling a few feet the string will feed through guide members 62 with the proper spacing on liner 74.

During the manufacturing process if the strings become slack, bolt 116 is simply tightened to compress spring 118 creating more frictional contact of strap 112 with rollers 108 and 106 thereby increasing the resistance of the rollers to turning. This operation translates into increased and equal tension application on each individual string. Thus, the strings emerging from control device 48 each have equal tension hereon. If an increased or decreased drag occurs on one or more of the strings, the device 48 which exhibits a load-sharing characteristic, tends to dissipate any tension differences and equalizes the tension on the strings exiting from device 48.

It should be noted that in the preferred embodiment the height of guide bars 36–42 above supply spools 16 is preferably at least 18" to ensure easy removal of string from spools 16. It has been found that if the guide bars are too close to the spools, string tendency is to hang up on the spool and cause resistance to removal. The configuration wherein guide bars 36–42 are positioned at least 18" above the top of the spools also facilitates transfer from one spool to another as the first spool runs out of the string.

From the above description, it can be appreciated that the present invention is a dispensing apparatus which can be used with a number of different types of threads, strings, or monofilaments and which maintains equal and adjustable tension on a plurality of such strings or threads while the strings or threads are drawn from the apparatus. By accurate control of the string tension achieved with the present invention, the string has less tendency to wander and therefore remains in a desired location as it is applied to a moving web of material. The tensioning control device of the dispensing apparatus of the present invention also minimizes the potential for string breakage or stretching due to excessive string tension. The tension is controlled accurately and to a uniform degree on all strings being pulled from the apparatus.

What is claimed is:

1. Apparatus for dispensing a plurality of string members from associated supply spools to a machine wherein string members are applied to a moving web, said machine acting to pull or draw the string members from said dispensing apparatus, comprising:

(a) a dispensing rack on which may be mounted a plurality of supply spools of string members;

(b) means on said dispensing rack for applying drag on the string members in resistance to pull on said string members by said machine;

(c) means for simultaneously regulating the tension on each of said string members, said regulating means disposed on said dispensing rack to receive said string members from said drag means;

(d) guide means connected to said machine for guiding said string members from said tension regulating means to the moving web; and (e) means on said dispensing rack for guiding said string members from said supply spool to said drag means.

2. Apparatus in accordance with claim 1 wherein said tension regulating means further comprises:

(a) a first substantially cylindrical roller member having a rotational axis disposed generally transverse to the path of said string members, said string members wrapped about and in frictional contact with said roller member, said roller member mounted to said dispensing rack for rotation about said rotational axis; and (b) adjustable brake means providing controlled resistance to the rotation of said roller members to thereby regulate tension on said string members.

3. Apparatus in accordance with claim 2 wherein said brake means comprises:

(a) a strap having a surface thereof in frictional contact with said first cylindrical roller member; and (b) means for adjustably affixing said strap to said rack whereby said frictional contact between said strap and said roller member may be increased or decreased to thereby regulate tension on said string members.

4. Apparatus in accordance with claim 2 further comprising a second substantially cylindrical roller member rotatably mounted to said rack and having a rotational axis disposed generally transverse to the path of said string members, said rotational axes of said first and second roller members disposed in parallel horizontal planes which are vertically offset with respect to each other so that said string members are first wrapped about and in contact with a frontwardly facing side of the lower of said first and second roller members and then wrapped about and in contact with a generally rearwardly facing side of said upper of said roller members.

5. Apparatus in accordance with claim 4 wherein said brake means comprises:

(a) a strap wrapped about and having a surface in frictional contact with said upper roller member and an oppositely disposed surface in frictional contact with said lower roller member; and (b) means for adjustably securing said strap to said rack whereby the frictional contact between said strap and said first and second roller members may be increased or decreased to regulate string tension.

6. Apparatus in accordance with claim 2 wherein said drag application means comprises:

(a) a plurality of rod members mounted to said rack and affixed against rotation thereon, said rod members having longitudinal axes aligned transverse to the path of said string members and said rod members spaced apart whereby said string members are threaded about and in frictional contact with the outer surfaces of said rod members.

7. Apparatus in accordance with claim 6 wherein said plurality of said rod members comprises:

(a) first and second rod members having a first outside diameter;

(b) a third rod member having an outside diameter greater than said first outside diameter, said first outside diameter, said third rod member disposed intermediate said first and second rod members, said longitudinal axes of said first, second and third rod members disposed parallel to each other and said rod members mounted so that the bottom surfaces thereof lie in a single horizontal plane, said string members being threaded above said first and second rod members and beneath said third rod member and in frictional contact therewith.

8. Apparatus for dispensing a plurality of string members from supply spools to a machine wherein the string members are applied to a moving web, said machine acting to pull the string members from said dispensing apparatus, comprising:

(a) a dispensing rack on which may be mounted a plurality of supply spools of string;

(b) a string tension device connected to said dispensing rack and through which said string members are threaded from said dispensing rack, said tension device comprising:

(i) a housing having oppositely disposed sides each with a plurality of aligned spaced apertures to guide said string members into and out of said housing;

(ii) means disposed within said housing for adjustably regulating the tension on said string members and maintaining the tension on each of said string members equal;

(c) means connected to said machine for guiding said string members from said tension device to said machine.

9. Apparatus in accordance with claim 8 wherein said tension means comprises:

(a) first and second rollers rotatably mounted to said housing having rotational axes disposed generally transverse to the path of said string members and disposed in horizontal planes that are vertically offset with respect to each other, said string members wrapped about and in frictional contact with said first and second rollers;

(b) brake means for providing controlled adjustable resistance to the rotation of said first and second rollers to thereby regulate the tension on said string members.

10. Apparatus in accordance with claim 9 wherein said brake means further comprises:

(a) a strap wrapped about and having one surface thereof in frictonal contact with said upper of said first and second rollers and an oppositely disposed surface in frictional contact with said lower of said first and second rollers; and (b) means mounted in said housing and connected to said strap for regulating the frictional contact of said strap with said first and second rollers to thereby control the resistance of said rollers to rotation and thus the application of tension on said string members.

11. Apparatus in accordance with claim 10 wherein said frictional contact adjustment means comprises:

(a) a clamp to which opposite ends of said strap are affixed;

(b) a bolt threadably mounted in said clamp and extending through an aperture in said housing; and (c) spring means in contact with said bolt and said housing and operative to apply tension to said strap whereby said frictional contact of said strap on said rollers may be regulated.

12. Apparatus for dispensing a plurality of string members from associated supply spools to a machine wherein the string members are applied to a moving web, said machine acting to pull the string members from said dispensing apparatus, comprising:

(a) a dispensing rack on which may be mounted a plurality of supply spools;

(b) means connected to said rack and to the machine for guiding said string members from said spools to the moving web; and (c) means mounted on said rack and interposed in the path of said string members from said supply spools to said machine for regulating the tension on said string members and maintaining equal tension on each of said string members, said tension regulating means comprising:

(i) first and second roller members rotatably mounted to said rack, said roller members having substantially horizontally disposed rotational axes transverse to the path of said string members, said rotational axes vertically offset with respect to each other and said string members wrapped about said first and said second roller members;

(ii) means for providing adjustable resistance to the rotation of said rollers to thereby regulate tension on said string members.

13. Apparatus in accordance with claim 12 wherein said tension adjusting means further comprises:

(a) a pretensioning means interposed in the path of said string members from said supply spools to said first and second rollers and in frictional contact with said string members for applying drag on the string members in resistance to the pull on said string members.

14. Apparatus in accordance with claim 13 wherein said pretensioning means comprises:

(a) first and second rod members having longitudinal axes disposed parallel to each other and generally transverse to the path of said string members, said first and second rod members mounted to said dispensing rack and spaced apart with said axes thereof lying in a common horizontal plane, and said first and second rod members having a first outside diameter;

(b) a third rod member having a second outside diameter greater than said first outside diameter and disposed between said first and second rod members, said third rod member having a longitudinal axis aligned parallel to the longitudinal axes of said first and second rod members, said third rod member mounted on said rack such that said first, second and third rod members have bottom surfaces lying in a common horizontal plane, said string members threaded over said first and second rod members and below said third rod member and in frictional contact with said first, second and third rod members.

15. Apparatus in accordance with claim 12 wherein said guiding means comprises:

(a) a plurality of generally horizontal disposed guide bars mounted to said rack and vertically positioned above said spools, each of said guide bars having a plurality of apertures therein through which string members are threaded;

(b) a guide track mounted on said machine;

(c) a distributor bar mounted on said guide track and having apertures therein through which said string members are threaded from said adjustable tensioning means; and (d) a plurality of guide members adjustably mounted to said guide track, each of said guide members having an aperture therein through which one of said string members are threaded from said distributor bar and directed generally in the direction of the moving web, each of said guide members adjustable to regulate the spacing between adjacent string members on said web.

16. In an apparatus wherein a plurlity of strings are pulled from supply spools, apparatus for maintaining tension equally distributed over said strings and adjusting the tension on said strings, comprising:

(a) a housing having oppositely disposed first and second end walls, each end wall having a plurality of apertures therein, said housing also having a pair of oppositely disposed side walls;

(b) roller means rotatably mounted to said side walls and having a rotational axis disposed generally transverse to the path of said string through said apparatus for frictionally engaging said string members to resist the pull of said string members and thereby apply tension to said string members, said string members being threaded through the apertures in said first wall, wrapped about said roller means, and threaded through the apertures in said second end wall;

(c) brake means for providing controlled adjustable resistance to the rotation of said roller means.

17. Apparatus in accordance with claim 16 wherein said roller means comprises:

(a) first and second cylindrical roller members rotatably mounted to said end walls and having rotational axes parallel to each other and disposed generally transverse to the path of string through said apparatus, said first and second roller members vertically offset with respect to each other, said lower of said roller members positioned proximate said second end wall and said upper of said roller members positioned proximate said first end wall, said string members being threaded through said first end wall and wrapped about said lower of said roller members with said string members in contact with a surface of said lower of said roller members facing said second end wall and said string members then being wrapped about said upper of said roller members with said string members in contact with a surface of said upper of said string members facing said first end wall, said string members then being threaded through apertures in said second end wall.

18. Apparatus in accordance with claim 16 wherein said brake means further comprises a strap wrapped about and in frictional contact with said roller means, said strap adjustably mounted to said housing such that the frictional contact of said strap on said roller means can be regulated to control the resistance of said roller means to rotation.

19. Apparatus in accordance with claim 16 further comprising means for applying drag on said string members prior to said string members being wrapped about said roller means, whereby said string members effectively grip the surface of said roller means.

20. Apparatus in accordance with claim 19 wherein said drag application means comprises a plurality of rod members rigidly mounted to said housing and positioned in the path of string travel whereby said string members are threaded about said members and in fractional contact therewith.

21. Apparatus in accordance with claim 20 comprising:

(a) first and second rod members having a first outside diameter and longitudinal axes aligned parallel to each other and disposed in a common horizontal plane;

(b) a third rod member having a second outside diameter greater than said first outside diameter and a longitudinal axis parallel to the longitudinal axes of said first and second rod members, said third rod member being disposed between said first and second rod members such that the bottom surface of said first and second and third rod members lie in a common horizontal plane whereby said string members are threaded over said first and second rod members and below said third rod member and in frictional contact therewith.

* * * * *